US012509875B1

(12) United States Patent
Patrick

(10) Patent No.: US 12,509,875 B1
(45) Date of Patent: Dec. 30, 2025

(54) CUSTOMIZABLE SKID APPARATUS WITH ROOF

(71) Applicant: Andrew Patrick, Madison, AL (US)

(72) Inventor: Andrew Patrick, Madison, AL (US)

( * ) Notice: Subject to any disclaimer, the term of this patent is extended or adjusted under 35 U.S.C. 154(b) by 209 days.

(21) Appl. No.: 18/237,651

(22) Filed: Aug. 24, 2023

Related U.S. Application Data

(60) Provisional application No. 63/446,932, filed on Feb. 20, 2023.

(51) Int. Cl.
*E04B 1/344* (2006.01)
*E04B 1/348* (2006.01)

(52) U.S. Cl.
CPC ..... *E04B 1/344* (2013.01); *E04B 1/3483* (2013.01)

(58) Field of Classification Search
CPC . E04H 2001/1283; E04H 1/1205; E04H 5/02; E04B 1/34336; E04B 1/3483; E04B 1/34384
See application file for complete search history.

(56) References Cited

U.S. PATENT DOCUMENTS 3,480,174 A * 11/1969 Sherwood ..... B65D 88/022 294/67.4
7,021,010 B2 * 4/2006 Smith ..... E04B 1/34331 296/210
7,360,813 B2 * 4/2008 Ting ..... A61G 3/001 296/65.05
8,925,470 B2 * 1/2015 Hart ..... B65D 71/0092 108/55.1
9,067,721 B2 * 6/2015 Mullaney ..... E04H 1/005
9,212,499 B1 * 12/2015 Maurer ..... E04H 5/02
9,334,105 B2 * 5/2016 Dinter ..... B65D 88/121
2008/0297103 A1 * 12/2008 Windsor ..... H02J 7/0029 361/601
2009/0077904 A1 * 3/2009 Ziegler ..... E04B 1/3483 52/745.13
2013/0186010 A1 * 7/2013 Condie ..... E04H 1/005 52/79.5
2022/0385046 A1 * 12/2022 Soverns ..... H02B 5/00

* cited by examiner

*Primary Examiner* — Brian E Glessner
*Assistant Examiner* — Daniel J Kenny
(74) *Attorney, Agent, or Firm* — AdamsIP, LLC; Stephen Thompson; J. Hunter Adams

(57) ABSTRACT

A customizable skid apparatus including a roof structure covering a skid on which equipment may be mounted is provided. A frame is attached to the skid, and the roof is attached to the frame. The roof may be expandable and contractible, in which case the roof may include two opposing roof panels that may be moved between a contracted position and an expanded position in which the coverage of the roof is expanded beyond the footprint of the skid. The frame includes multiple lift lugs and is designed so that the entire apparatus can be lifted from the lift lugs using a crane or hoist without the need for a spreader bar of lifting beam.

11 Claims, 14 Drawing Sheets

CUSTOMIZABLE SKID APPARATUS WITH ROOF

CROSS-REFERENCE TO RELATED APPLICATIONS

This application claims the benefit of U.S. Provisional Application Ser. No. 63/446,932, filed on Feb. 20, 2023, which application is incorporated herein in its entirety by reference.

FIELD OF THE INVENTION

The present disclosure relates generally to a customizable skid apparatus. The skid apparatus may include an expandable and contractible roof structure. The skid apparatus may also include a building structure to house certain types of equipment on the skid apparatus.

BACKGROUND

Structural skids are commonly used in many industrial applications for mounting various types of equipment onto the skid, such as piping, valves, pumps, compressors, tanks, heat exchangers, and other similar types of industrial equipment. Mounting such equipment on structural skids allows for pre-fabrication before placement in the field and also for transport of the skid with mounted equipment as a single unit. To lift the unit including both the skid and the mounted equipment, skids typically have attachment points connected to the skid so that the skid unit can be lifted by a crane or hoist to load the unit onto and off of a truck for transport and placement in the field. However, if equipment is pre-mounted onto the skid, a spreader bar or lifting beam is often required to provide separation of the straps or chains used for lifting the skid so that the straps or chains are connected vertically between the skid and the bar or beam to ensure that the straps or beams do not contact any of the equipment mounted on the skid, which could cause damage to the equipment during loading and unloading. In addition, when skid units are placed in the field in an outdoor environment, it would be desirable to provide a roof structure that covers the equipment to protect the equipment from prolonged and repeated exposure to environmental conditions such as sun and rain, as well as from extreme weather such as hail, which may cause damage to the equipment or result in premature failure of various components of the equipment.

In some particular industrial applications, permanent installations of equipment are typically utilized. For example, when purchasing natural gas from a supplier, utilities must provide a purchase station to meter, condition, regulate, and deliver the gas into a pipeline system. With a push for renewable energy sourced from renewable natural gas (RNG), such purchase stations must be built at RNG facilities to take custody of the gas from RNG developers. These purchase stations require much of the same equipment and a similarly sized footprint as those of stations used to purchase conventional gas from transmission pipeline companies at similar quantities. These stations or assets are typically fixed in the ground and non-portable. In such applications, it would be desirable to provide temporary, pre-fabricated skid systems that can be moved between sites as needed so that purchase stations can be relocated and installed at any RNG facility regardless of its geographic location.

SUMMARY

In one aspect, a skid apparatus including an expandable and contractible roof structure and a method of using the skid apparatus are provided. The apparatus comprises a skid on which equipment may be mounted and a frame attached to the skid and extending upwardly from the skid. The frame provides a support structure for a roof having foldable roof panels for covering the equipment mounted on the skid. The frame also allows the apparatus to be lifted from a plurality of lift lugs attached to the frame so that the apparatus can be lifted by a crane or hoist from a high point of the apparatus that is vertically above the skid rather than lifting the entire apparatus from the skid itself. This eliminates the need for a separate spreader bar or lifting beam to lift the skid apparatus with a crane or hoist. Equipment may be removably secured to the skid so that the skid is customizable to suit a user's specific needs. In a preferred embodiment, the skid may also include a control room and/or analyzer building attached to the skid, preferably outside the footprint of the roof. The control room may be utilized to house certain pieces of equipment, such as process control equipment used for controlling the equipment mounted on the skid or analysis equipment used for analyzing properties of fluids being handled by the equipment mounted on the skid.

The skid preferably comprises two opposing longitudinal beams and two opposing lateral beams disposed perpendicularly to the longitudinal beams. The longitudinal beams are parallel to each other and define a length of the skid, and the lateral beams are also parallel to each other and define a width of the skid. The longitudinal and lateral beams are attached to each other to form a generally rectangular skid structure. The skid preferably includes a plurality of cross beams connecting the two longitudinal beams to each other. The cross beams provide structural support for the skid and also support for a skid floor configured for removably securing equipment to the skid.

The frame of the apparatus preferably comprises a plurality of vertical support posts each attached to the skid and extending upwardly from the skid. In a preferred embodiment, each of the support posts is attached to one of the longitudinal beams of the skid, and one support post is attached to the skid at each of four corners of the skid where the longitudinal beams and lateral beams are joined to each other. The frame further comprises a plurality of support members that are connected to the support posts at an upper end of the support posts. The plurality of support members preferably includes two opposing longitudinal members disposed vertically above the longitudinal beams of the skid and two opposing lateral members disposed vertically above the lateral beams of the skid. The longitudinal members are disposed parallel to the longitudinal beams, and the lateral members are disposed parallel to the lateral beams. In a preferred embodiment, the plurality of support members further includes a plurality of interconnecting members attached to the longitudinal and lateral members to form a truss structure. The truss structure provides structural support for the frame and distributes horizontal loads or stresses when lifting the apparatus using the lift lugs, which are preferably attached to the frame at an upper end of at least the vertical support posts that are located at the corners of the skid.

The apparatus further comprises a roof structure comprising a central roof section and two opposing roof panels. The central roof section is attached to the frame of the apparatus and disposed in a position in which the central roof section covers at least a portion of the skid floor. The two opposing roof panels are each hingedly attached to the frame on opposite sides of the central roof. The roof panels are configured to pivotally move between a folded position in which the size of the roof is minimized for transporting or storing the apparatus and an expanded position in which the size of the roof is expanded to enlarge the coverage of the roof structure beyond a perimeter of the central roof and the skid floor when the apparatus is in use. Each roof panel may be pivoted downwardly to a generally vertical position when in the folded position and may be pivoted upwardly toward a horizontal position when in the expanded position.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
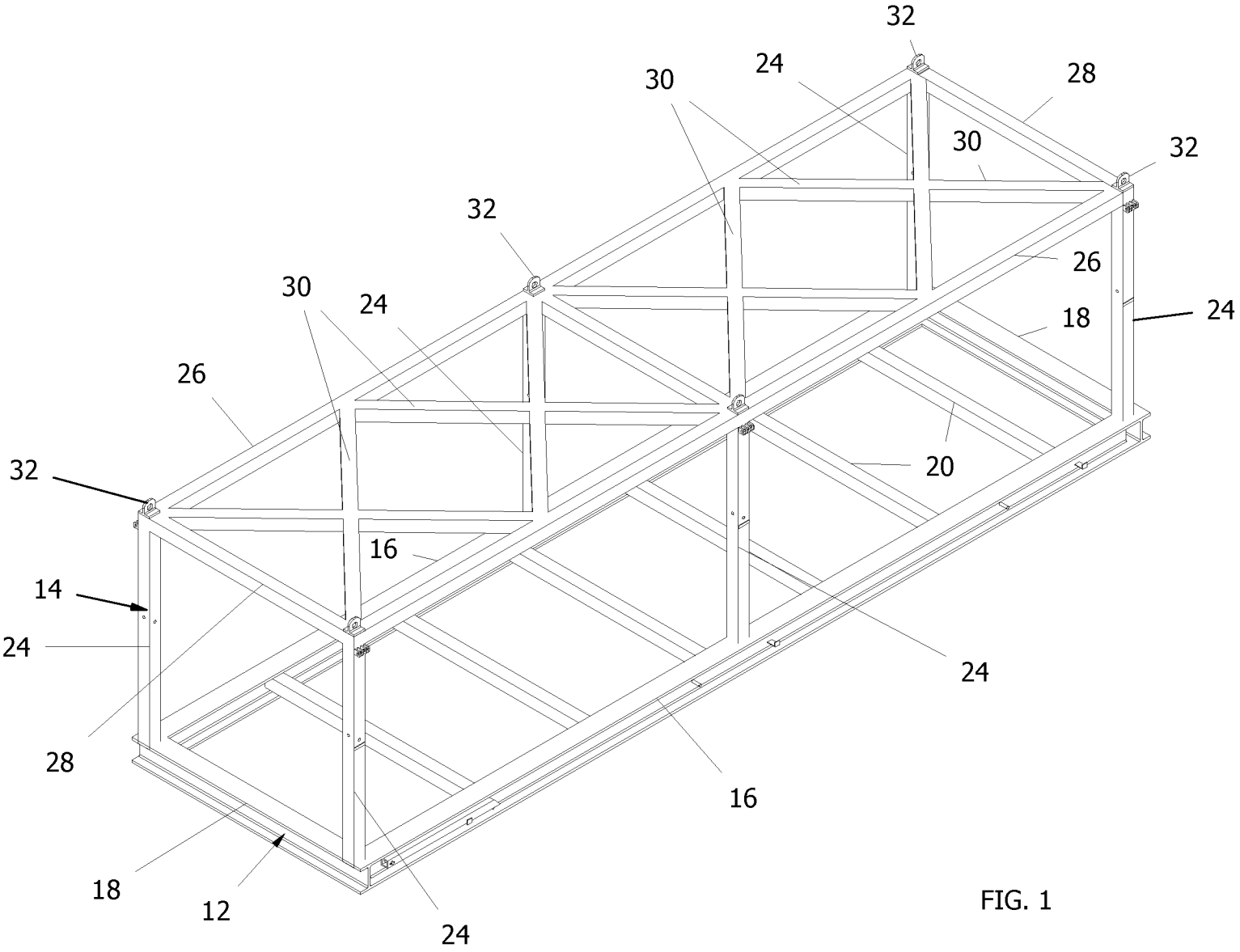
FIG. 1 shows a perspective view of a skid with an attached frame in accordance with the present disclosure.

In one aspect, a skid apparatus 10 including an expandable and contractible roof structure 34 and a method of using the skid apparatus 10 are provided. FIGS. 1-11 illustrate a preferred embodiment of the skid apparatus 10 or components thereof. FIGS. 12-19 illustrate alternative embodiments that may be utilized in specific applications of the skid apparatus 10. The skid apparatus 10 comprises a skid 12 on which various types of equipment 70 may be mounted, a frame 14 attached to the skid 12 and extending upwardly from the skid 12, and a roof structure 34 attached to the frame 14 for covering the equipment 70 mounted on the skid 12. The frame 14 provides a support structure for the roof 34, which preferably has foldable roof panels 38 for expanding the coverage of the roof structure 34. The apparatus 10 further comprises a plurality of lift lugs 32 attached to the frame 14 so that the apparatus 10 can be lifted by a crane or hoist from a high point of the apparatus that is vertically above the skid 12 by attaching straps or chains to the lift lugs 32. Attaching the lift lugs 32 to the frame 14 above the skid 12 eliminates the need for a separate spreader bar or lifting beam to lift the skid apparatus 10 with a crane or hoist. FIG. 1 illustrates a preferred embodiment of the skid apparatus 10 with the roof structure 34 removed to illustrate all of the structural support components of the apparatus 10. FIGS. 2-5 illustrate a preferred embodiment of the skid apparatus 10 with the roof structure 34 installed on the frame 14.

As best seen in FIG. 1, the skid 12 preferably comprises two opposing longitudinal beams 16 and two opposing lateral beams 18 each disposed perpendicularly to the longitudinal beams 16. The longitudinal beams 16 are parallel to each other and define a length of the skid 12, and the lateral beams 18 are also parallel to each other and define a width of the skid 12. The longitudinal 16 and lateral beams 18 are attached to each other to form a generally rectangular skid structure 12. In a preferred embodiment, each of the longitudinal 16 and lateral beams 18 comprises an I-beam, which are welded or mechanically connected to each other at four corners of the skid 12. In a preferred embodiment, the skid 12 further comprises a plurality of cross beams 20 connecting the two longitudinal beams 16 to each other, as best seen in FIG. 1. Each of the cross beams 20 may be welded or mechanically connected at each end to one of the longitudinal beams 16 to provide structural support for the skid 12. Additional reinforcing structural members may be utilized, depending on required load distributions.

Figure 12:
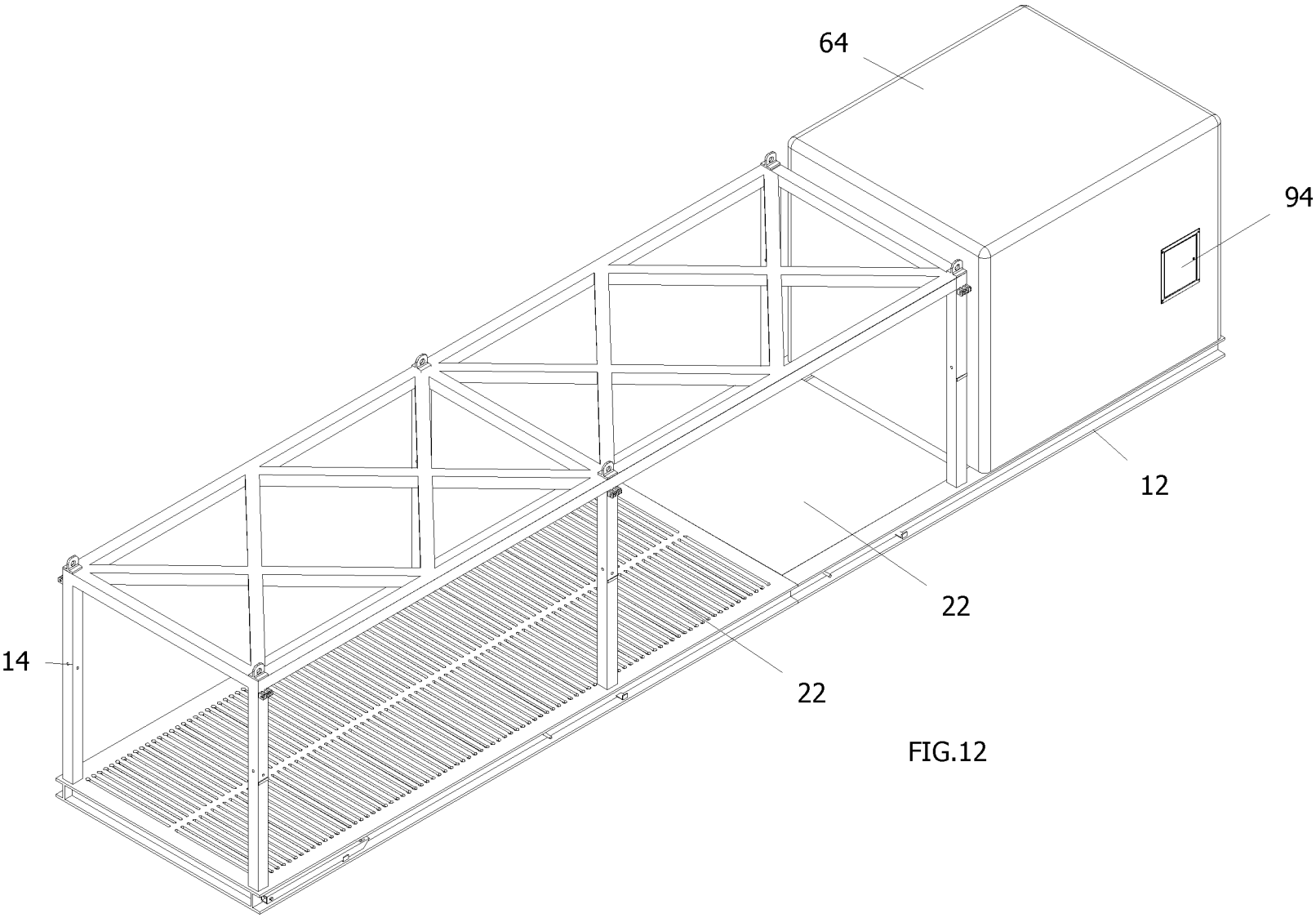
FIG. 12 shows a perspective view of an alternative embodiment of a skid apparatus including a control in accordance with the present disclosure.

In a preferred embodiment, as best seen FIG. 12, the skid 12 further comprises a skid floor 22. In one embodiment, the cross beams 20 may provide structural support for the skid floor 22, which may be fastened to or permanently attached to the cross beams 20, the longitudinal beams 16, and/or the lateral beams 18. The skid floor 22 may be configured for removably securing equipment 70 to the skid 12. To this end, the skid floor 22 may preferably comprise a grated structure or may include slots so that equipment may be bolted to or otherwise fastened to the skid floor 22 to removably secure the equipment to the skid 12. As used herein, the term "skid floor" may refer to any structural component that is attached to the beams 16, 18, or to any similar type of structural components that form the skid 12, and that is located within the footprint of the skid 12. For instance, in some embodiments, the crossbeams 20 themselves may function as the skid floor if equipment 70 is secured to the crossbeams 20. For example, the crossbeams 20 may be more suitable for securing large, heavy pieces of equipment thereto, while a grated structure supported by the crossbeams 20 may be more suitable for attaching smaller pieces of equipment thereto. Because both types of structures are suitable for removably securing equipment 70 thereto, either of the structures 20 or 22, or any similar type of structure, may be considered to be a "skid floor" as used herein. In some embodiments, the skid floor 22 may include slots or penetrations that allow equipment 70 to be bolted or otherwise fastened to the crossbeams 20 so that the skid floor is formed by both crossbeams 20 and floor 22. FIGS. 14-19 illustrate an embodiment showing example equipment 70 that may be mounted onto the skid floor 22, which in this case is equipment for a gas metering system, as described below. In a preferred embodiment, the width of the skid 12 as defined by the length of the lateral beams 18 is a width that allows the skid apparatus 10 to be loaded onto and transported by a semi-trailer or rail car. In a preferred embodiment, the width of the skid 12 is no more than 8.5 feet.

Figure 5:
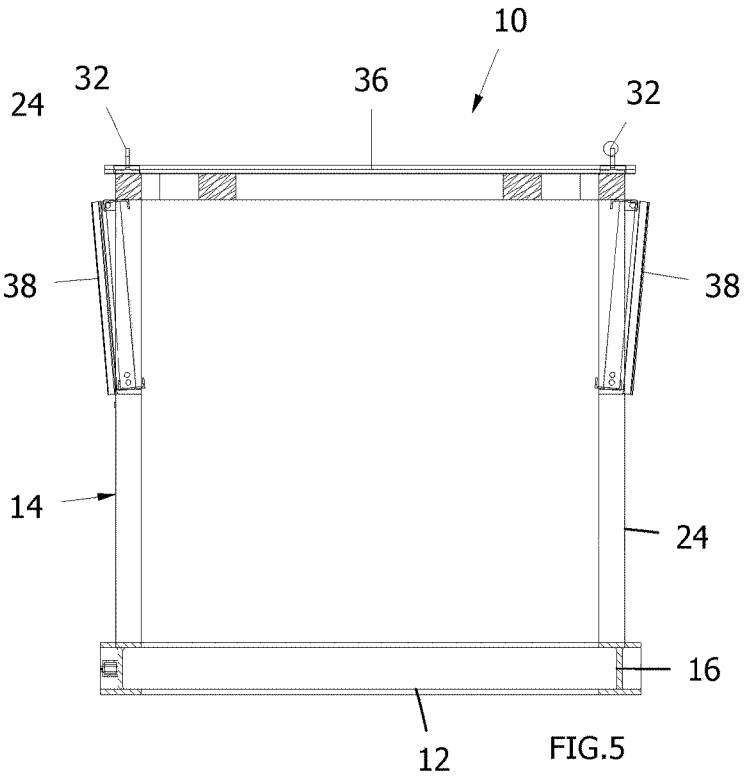
FIG. 5 shows a cross-sectional view of a skid apparatus in accordance with the present disclosure.
Figure 4:
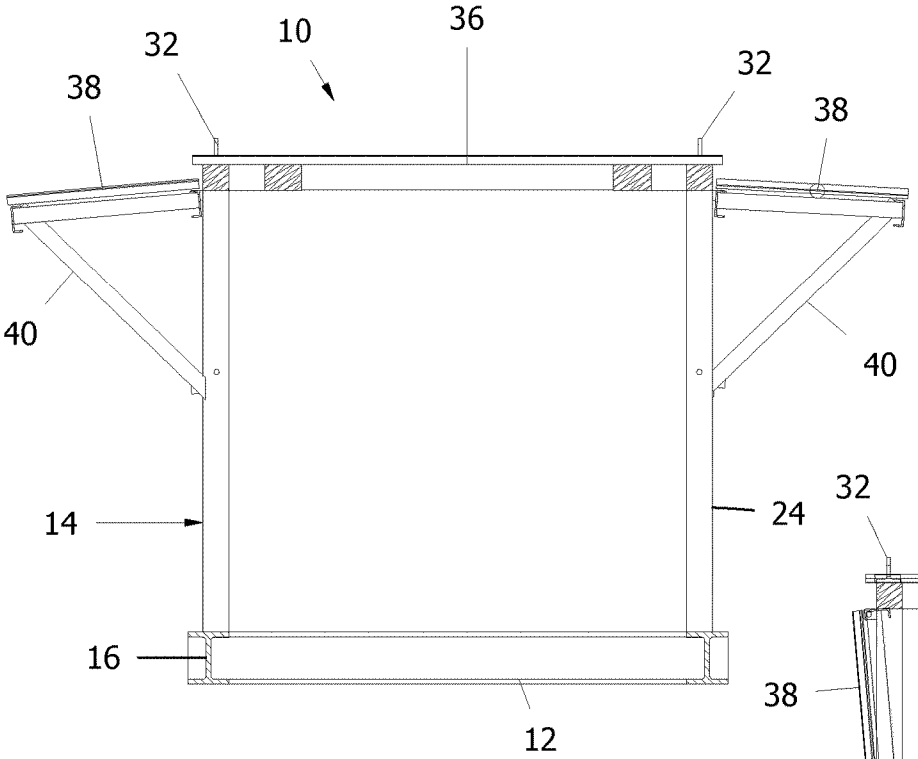
FIG. 4 shows a cross-sectional view of a skid apparatus in accordance with the present disclosure.

In a preferred embodiment, as best seen in FIG. 1, the frame 14 of the apparatus 10 comprises a plurality of vertical support posts 24 each attached to the skid 12 and extending upwardly from the skid 12 when the apparatus 10 is in an upright position, as best seen in FIGS. 4 and 5. Each of the support posts 24 is attached to at least one of the longitudinal beams 16 and the lateral beams 18. In a preferred embodiment, the skid apparatus 10 comprises at least four vertical support posts 24 with one of the at least four support posts 24 attached to the skid 12 at each respective one of the four corners of the skid 12 where the longitudinal beams 16 and lateral beams 18 are joined to each other. In a preferred embodiment, the length of the skid 12 as defined by the length of the longitudinal beams 16 is a length that allows the skid apparatus 10 to be transported by a semi-trailer or rail car and to be lifted as a single unit. However, it should be understood by one of skill in the art that the length of the skid may be varied and still fall within the scope of the present disclosure. For instance, in one preferred embodiment, as best seen in FIG. 1, the skid apparatus 10 is approximately forty (40) feet in length and comprises six vertical support posts 24, including four posts 24 at each respective corner of the skid 12 and two middle posts 24 attached to each respective one of the longitudinal beams 16 at an approximate midpoint of the skid 12. In this embodiment, the apparatus 10 may include three equidistantly spaced posts 24 attached to each one of the longitudinal beams 16 of the skid 12. The support posts 24 are preferably welded to the skid 12 but may be fastened or otherwise rigidly joined to the longitudinal 16 and/or lateral beams 18. When the apparatus 10 is in an upright position, the longitudinal beams 16 and the lateral beams 18 of the skid 12 are disposed in a generally horizontal position, and the support posts 24 of the frame 14 are disposed in a generally vertical position perpendicular to the skid beams 16, 18.

As best seen in FIG. 1, the frame 14 preferably further comprises a plurality of support members 26, 28 that are connected to the support posts 24 at an upper end of each one of the support posts 24. The plurality of support members preferably includes two opposing longitudinal members 26 disposed vertically above the longitudinal beams 16 of the skid 12 and two opposing lateral members 28 disposed vertically above the lateral beams 18 of the skid 12. The longitudinal members 26 are disposed parallel to the longitudinal beams 16, and the lateral members 28 are disposed parallel to the lateral beams 18. Each of the longitudinal members 26 is preferably disposed directly above one of the longitudinal beams 16, and each of the lateral members 28 is preferably disposed directly above one of the lateral beams 18 so that the overall footprint of both the skid 12 and frame 14 is approximately the same. Thus, the combination of the skid 12 and the frame 14 preferably has an overall shape that is generally a rectangular cuboidal shape. In the embodiment shown in FIG. 1 having six vertical support posts 24, the frame 14 preferably includes a third lateral support member that is disposed in a position parallel to the two lateral members 28 that are positioned directly above the lateral beams 18 of the skid 12. The third lateral member is attached to the upper end of each of the two middle support posts 24 and extends directly between the two middle support posts 24.

In a preferred embodiment, as best seen in FIG. 1, the frame 14 further comprises a plurality of interconnecting members 30 attached to the longitudinal members 26 and optionally to the lateral members 28 to form a truss structure. The truss structure provides structural support for the frame 14 and distributes horizontal loads when lifting the apparatus 10 using the lift lugs 32. The truss structure is preferably a planar truss that is disposed in a plane that is generally parallel to a plane in which the skid beams 16, 18 are disposed. Each of the truss members 30 may be connected to the frame 14 at an angle to each of the longitudinal members 26. In one example embodiment, each truss member 30 is disposed at an angle of approximately 45 degrees to a longitudinal member 26. Each of the truss members 30 may form a node with one of the longitudinal members 26 and either one of the lateral support members 28 (at corner nodes) or another truss member 30 (at nodes other than the corner nodes). In a preferred embodiment, each of the vertical support posts 24 is joined to the truss structure at one of the nodes of the truss at which one of the longitudinal members 26 forms a joint with one or more of the truss members 30 and one of the lateral support members 28. In a preferred embodiment, the truss structure also includes at least one node formed by a joint between two truss members 30 and one of the longitudinal support members 26 at a midpoint between each adjacent vertical support post 24 attached to each one of the longitudinal beams 16 of the skid 12. In a preferred embodiment, each truss member 30 may also form a joint with another truss member 30, preferably at 90-degree angles at a location between the two opposing longitudinal members 26, as shown in FIG. 1.

Each of the lift lugs 32 is attached to top side of the frame 14. In a preferred embodiment, as best seen in FIG. 1, each of the lift lugs 32 may be attached to top side of the upper end of each respective one of the vertical support posts 24. Thus, the apparatus 10 preferably has a lift lug 32 attached to the frame 14 at each node of the truss structure at which one or more of the truss members is joined to one of the vertical support posts 24. Each of the lift lugs 32 may comprise a ring structure, a hook structure, or a similar structure configured for attaching a chain, strap, rope, or similar type of lifting member that can also be attached to a crane or hoist to lift the skid apparatus 10 as a unit including both the skid 12 and the frame 14, as well as any equipment 70 mounted on the skid 12. The plurality of lift lugs 32 are positioned on the frame 14 in a configuration designed to enable the apparatus 10 to be lifted utilizing a lifting medium that is attached to a plurality of the lift lugs 32 so that the apparatus 10 can be lifted using a crane or hoist while maintaining the apparatus 10 in a generally upright position during the lifting process. As used herein, an "upright position" refers to a position in which the plane of the skid 12 is in a generally horizontal position that is generally parallel to the surface on which the skid 12 is installed, such as a ground surface or foundation surface, with the equipment installed on a top side of the skid 12. Thus, at least a portion of the plurality of lift lugs 32 may be distributed around a center of mass of the apparatus 10, for instance, at or near corners of the frame 14 of the apparatus 10, as shown in FIG. 1. The position of the center of mass of the apparatus 10 may be affected by the mass and location of various pieces of equipment 70 installed on the skid 12. Thus, the apparatus 10 may preferably include additional lift lugs 32 in various locations on the frame 14 for flexibility with respect to attachment locations for the lifting medium used to lift the apparatus 10.

Figures 2, 2A:
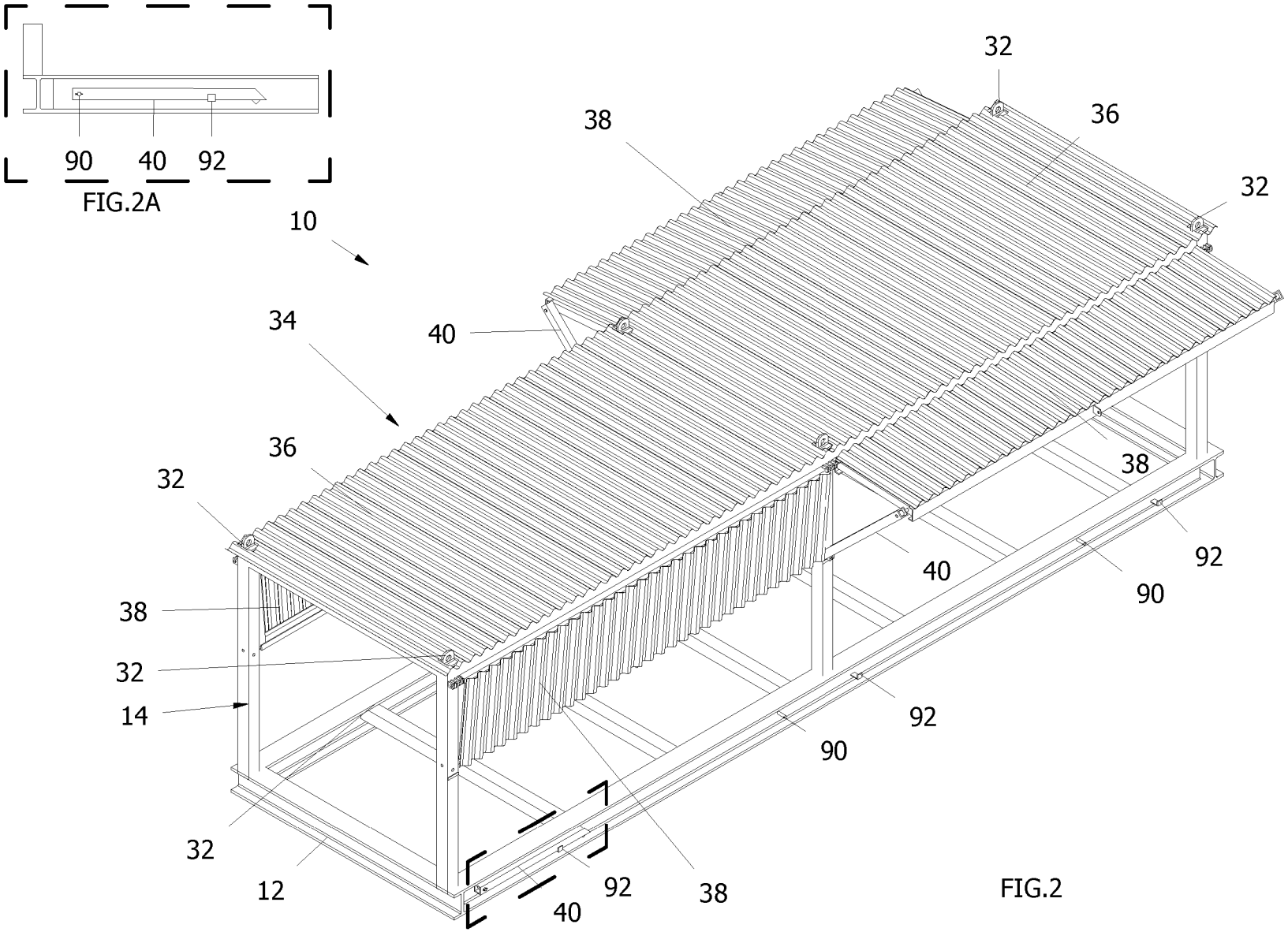
FIG. 2 shows a perspective view of a skid apparatus in accordance with the present disclosure.
FIG. 2A shows a partial perspective view of a skid apparatus in accordance with the present disclosure.
Figure 19:
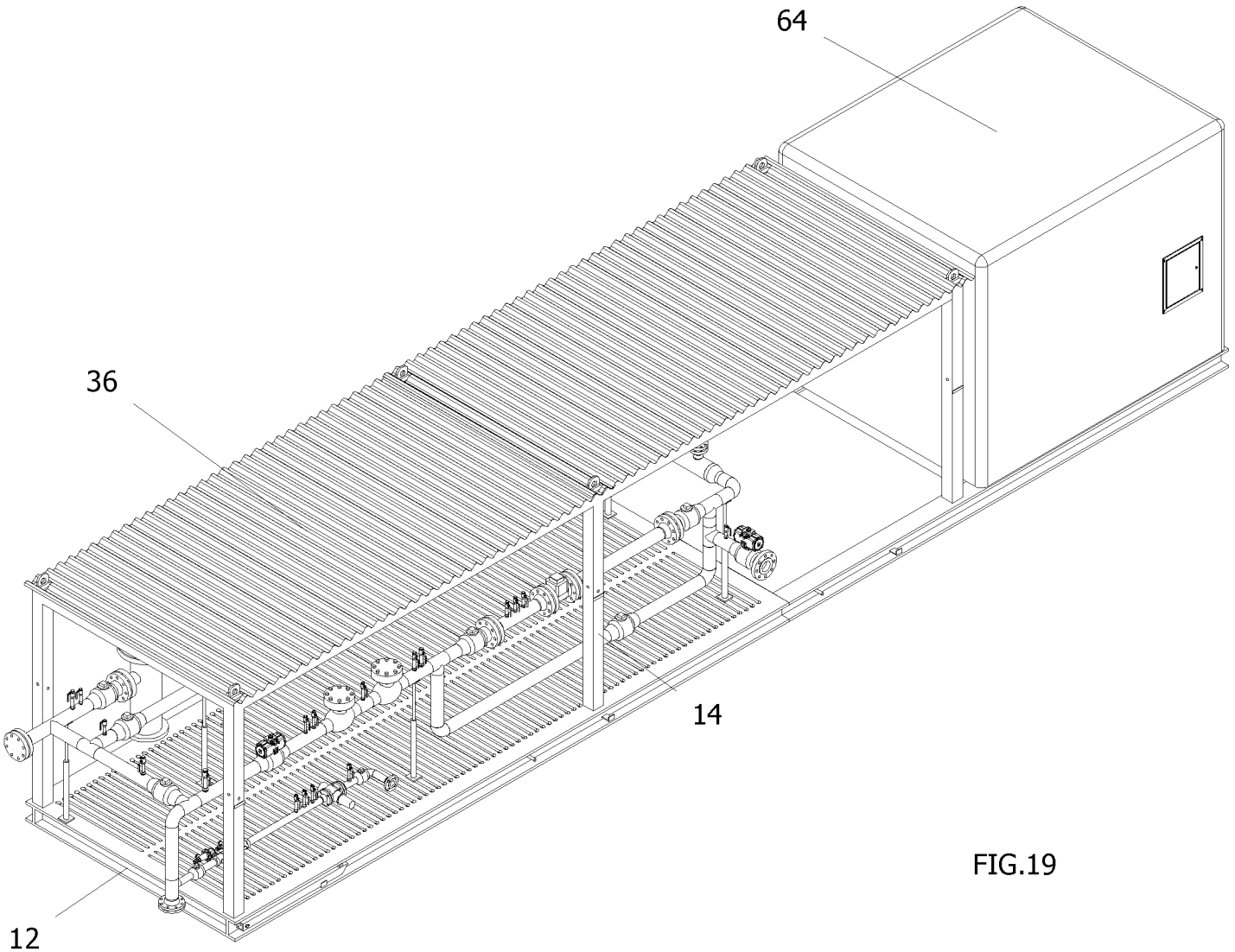
FIG. 19 shows a perspective view of an alternative embodiment of a skid apparatus without foldable roof panels in accordance with the present disclosure.

The skid apparatus 10 further comprises a roof structure 34 attached to the frame 14 of the apparatus 10 and positioned to cover the skid floor 22 and thus cover any equipment 70 mounted on the skid 12. Thus, in a preferred embodiment, all portions of the skid floor 22 have a portion of the roof structure 34 positioned vertically above the skid floor 22 when the apparatus 10 is in an upright position. As best seen in FIG. 2, the roof 34 preferably comprises a central roof section 36 and two opposing roof panels 38. The central roof section 36 is fixedly attached to the frame 14 so that the central roof section 36 remains in a fixed position relative to the skid 12. The central roof 36 may be attached to the longitudinal support members 26, the lateral support members 26, and/or the truss members 30, or any combination thereof. The central roof 36 is preferably disposed in a generally horizontal position that is generally parallel to the skid floor 22. The central roof 36 is disposed in a position in which the central roof 36 covers at least a portion of the skid 12, and it preferably covers substantially all of the skid 12. The central roof 36 and roof panels 38 may comprise corrugated sheet metal or any other material suitable for use as a roof. The two opposing roof panels 38 are configured to move into an expanded position in which the panels 38 expand coverage of the roof structure 34, which preferably expands coverage beyond a perimeter of both the central roof 36 and also the skid floor 22. In a preferred embodiment, the two opposing roof panels 38 are each hingedly attached to the frame 14 of the apparatus 10. The roof panels 38 are preferably configured to pivotally move between a folded or contracted position, as best seen in FIG. 5, in which the size of the roof 34 is minimized for transporting or storing the apparatus 10 and the expanded position, as best seen in FIG. 4, in which the size of the roof 34 is expanded to enlarge the coverage of the roof structure 34 beyond an outer perimeter of the skid 12 when the apparatus 10 is in use. Each roof panel 38 may be pivoted downwardly to a generally vertical position when in the folded position and may be pivoted upwardly from the generally vertical position toward a horizontal position when in the expanded position. In an alternative embodiment, as shown in FIG. 19, the roof structure 34 may not include expandable roof panels 38. As best seen in FIG. 2, the central roof 36 may be fitted around the lift lugs 32 so that the roof structure 34 does not interfere with using the lift lugs 32 for lifting the skid apparatus 10.

Figure 3:
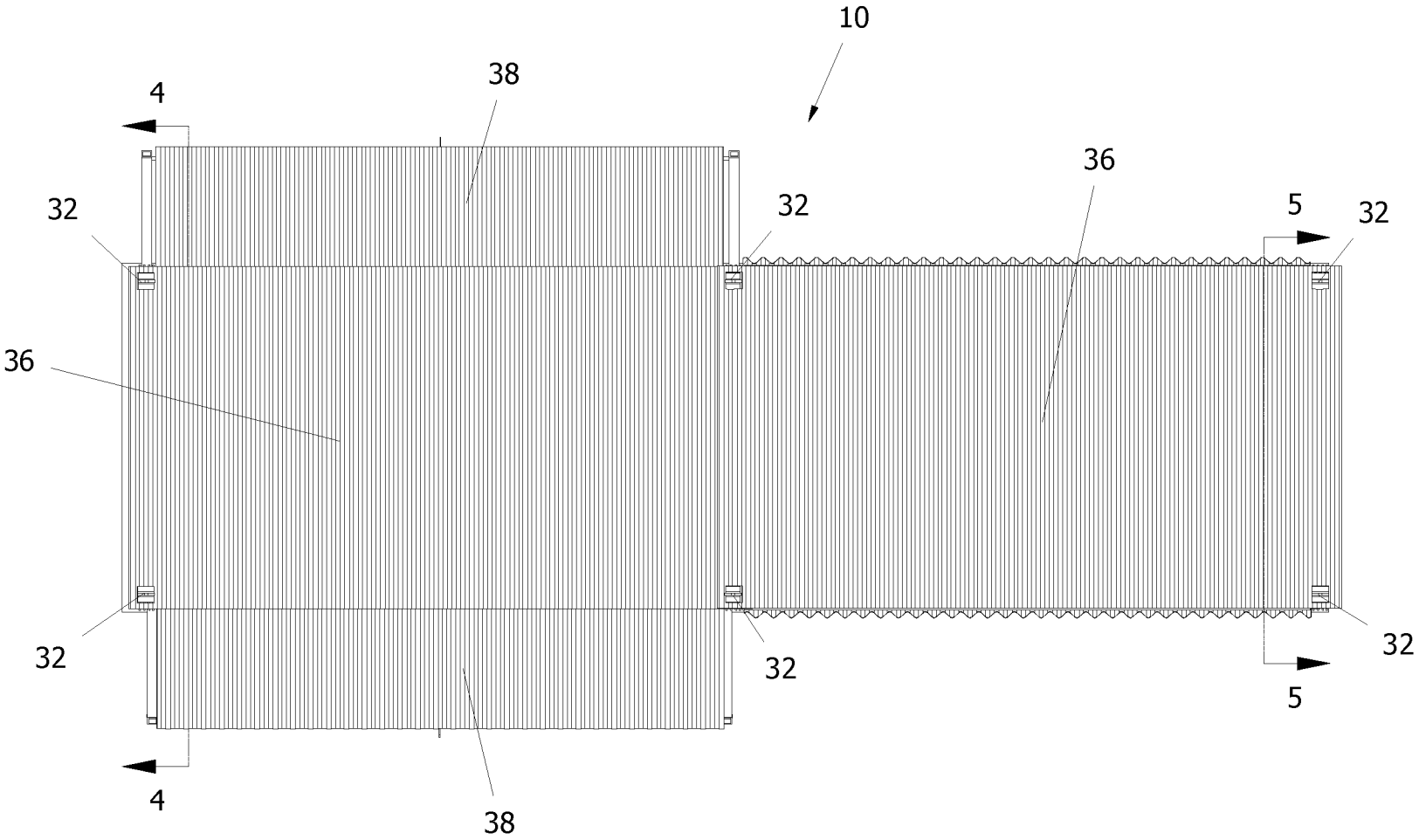
FIG. 3 shows a top plan view of a skid apparatus in accordance with the present disclosure.

In one preferred embodiment in which the apparatus 10 comprises at least two middle support posts 24 in addition to the four vertical support posts 24 located at the corners of the skid 12, the roof structure 34 may comprise two pairs of opposing roof panels 38, as best seen in FIGS. 2 and 3, which illustrate one pair of roof panels 38 in the folded position and one pair of roof panels 38 in the expanded position. Each of the individual roof panels 38 can preferably be individually moved between the folded and expanded positions. In alternative embodiments, the expandable roof panels 38 may be configured to move to the expanded position in a manner other than being pivoted. For instance, the panels 38 may be slidably attached to the central roof 36 and/or to the frame 14 so that the panels 38 can slide outward from the central roof 36 to expand coverage of the roof structure 34. It should be understood by one of skill in the art that the panels 38 may be attached to the central roof 36 and/or to the frame 14 in any manner suitable to allow the panels 38 to move between a position of expanded roof coverage and a contracted or folded position in which roof coverage is minimized, preferably to an extent of roof coverage that is substantially provided by only the central roof 36.

Figure 7:
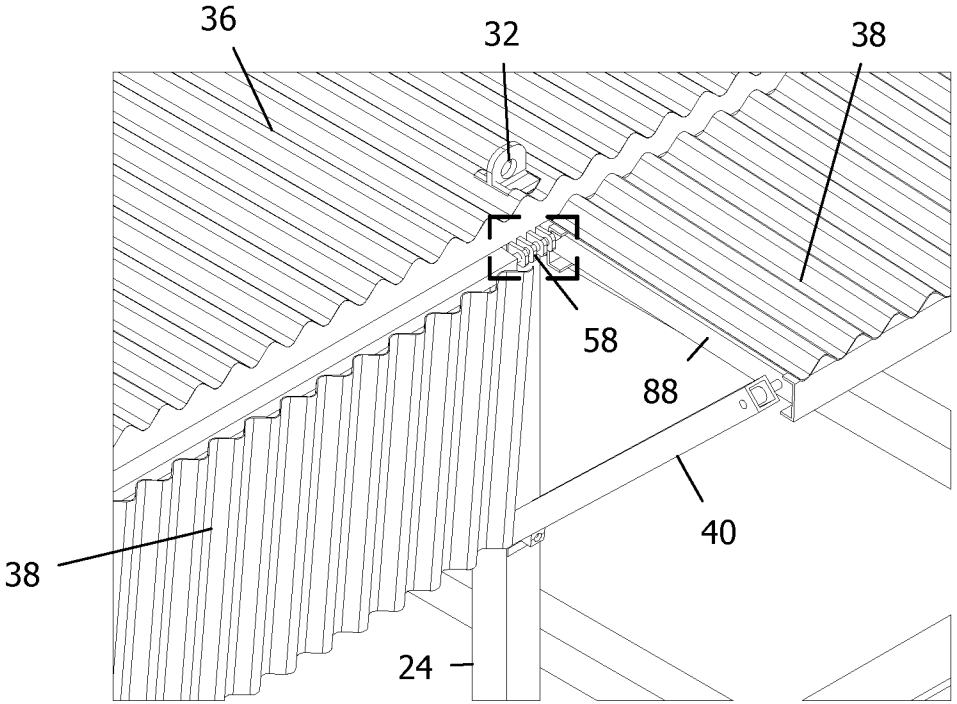
FIG. 7 shows a partial perspective view of a skid apparatus in accordance with the present disclosure.
Figure 9:
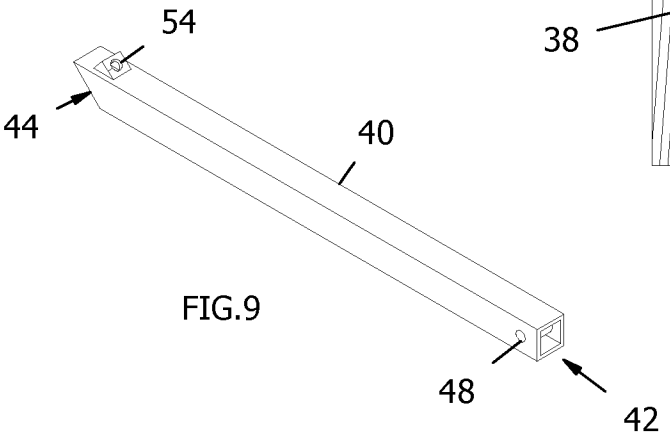
FIG. 9 shows a perspective view of a component of a skid apparatus in accordance with the present disclosure.

In a preferred embodiment, the apparatus 10 further comprises one or more braces 40 that support each of the roof panels 38 in the expanded position. In a preferred embodiment, each roof panel 38 includes two opposing braces 40 that each supports an opposing end of the roof panel 38. Each brace 40 preferably comprises an elongated arm configured to support the roof panel 38 by forming a rigid connection between the roof panel 38 and a component of the frame 14, which is preferably one of the vertical support posts 24, or another component of the apparatus. FIG. 9 shows a brace 40 detached from the apparatus 10, and FIG. 7 shows the brace 40 being used to support a roof panel 38 in the expanded position. In a preferred embodiment, each of the braces 40 is detachable from the apparatus 10, though alternatively the braces 40 may be designed to remain attached to the apparatus 10 in both the expanded and folded positions. In another preferred embodiment, each of the roof panels 38 is designed to remain permanently attached to the frame 14, though alternatively the roof panels 38 may be detachable.

Figure 6:
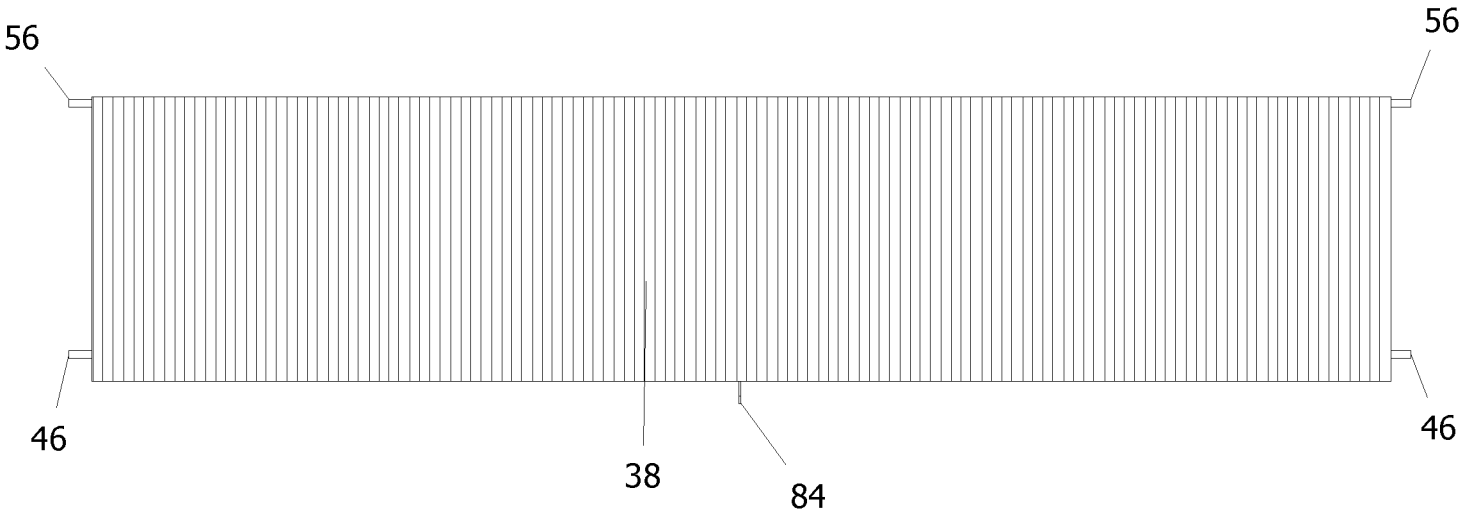
FIG. 6 shows an elevational view of a roof panel of a skid apparatus in accordance with the present disclosure.
Figure 8:
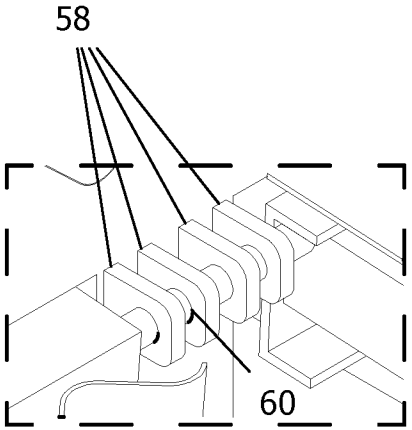
FIG. 8 shows a perspective view of a component of a skid apparatus in accordance with the present disclosure.
Figure 10:
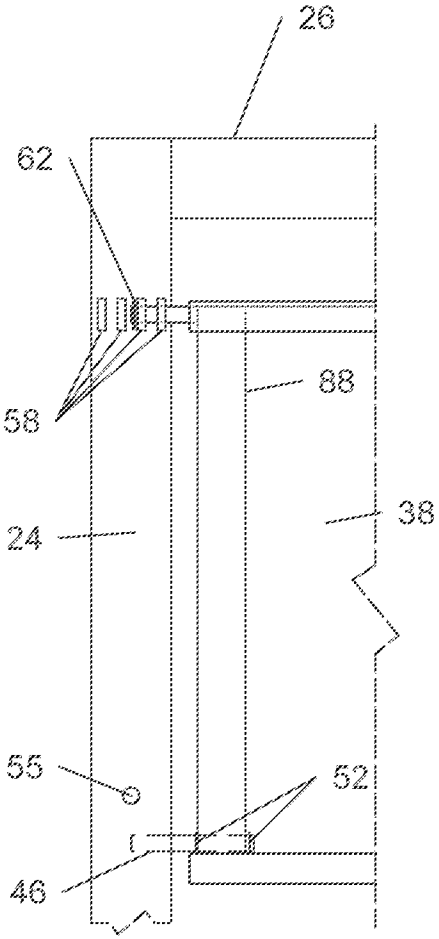
FIG. 10 shows a partial elevational view of a skid apparatus in accordance with the present disclosure.

FIG. 6 shows one roof panel 38 detached from the apparatus prior to installation. In a preferred embodiment, each roof panel 38 comprises a pair of opposing pins 56 configured for pivotally mounting the roof panel 38 onto mounting brackets 58 having an opening 60 extending through each of the brackets 58 so that the pins 56 may rotate within the openings 60. FIG. 8 shows a set of four mounting brackets 58 positioned adjacent to one another. In a preferred embodiment, the mounting brackets 58 are mounted onto the vertical support posts 24 near an upper end of each post 24 below the joint formed by the post 24 and the longitudinal support member 26. The brackets 58 are preferably welded to the support posts 24. Alternatively, the brackets 58 may be mounted onto the longitudinal support members 26. In a preferred embodiment, each pivot pin 56 extends through two adjacent brackets 58, as best seen in FIG. 10. Each middle support post 24 may thus have four adjacent brackets 58 to accommodate the pivot pins 56 of two adjacent roof panels 38, as best seen in FIG. 7. The pivot pins 56 are positioned within the openings 60 within the mounting brackets 58 so that the pins 56 can rotate freely within the openings 60. The pivot pins 56 are preferably welded onto the roof panels 38 and positioned within the openings 60 during the manufacturing process. The ends of the pivot pins 56 may be secured to the brackets 58 using a retaining clip 62 positioned outside the distal mounting bracket 58, as shown in FIG. 10.

Figure 11A:
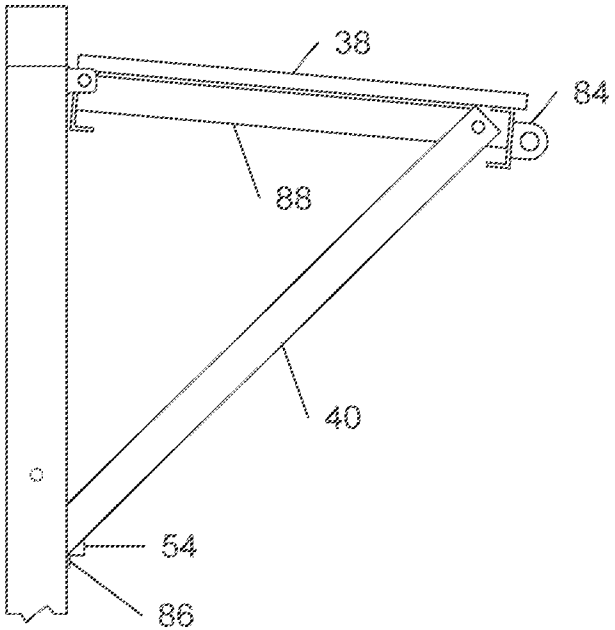
FIG. 11A shows a partial elevational view of a skid apparatus in accordance with the present disclosure.
Figure 11:
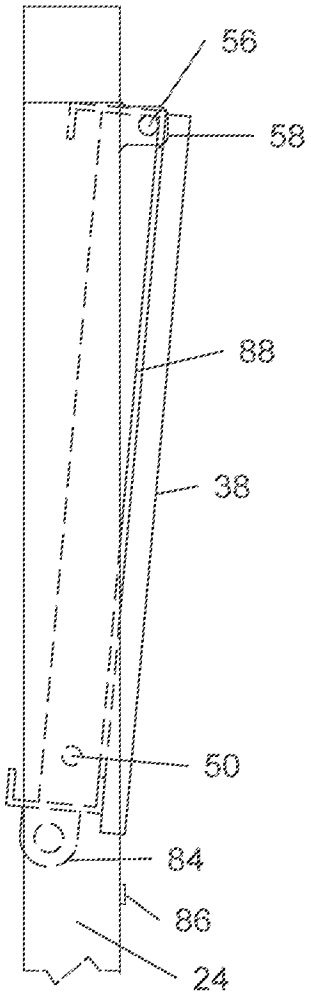
FIG. 11 shows a partial elevational view of a skid apparatus in accordance with the present disclosure.

In a preferred embodiment, distal ends of the roof panels 38 opposite the pivoting ends of the panels 38 may be removably secured to the frame 14 when the panels 38 are in the folded position to prevent the panels 38 from unsecured rotational movement. FIG. 10 shows a partial front view of one end of a roof panel 38 secured in the folded position, and FIG. 11 shows a side view of the roof panel 38 secured in the folded position. FIG. 11A shows a side view of the roof panel 38 secured in the expanded position. As best seen in FIG. 6, each roof panel 38 preferably includes a pair of opposing removable pins 46. Each of the pins 46 may be removably secured to one of the roof panels 38 by inserting the pin 46 through an opening in a structural member 88 of the roof panel 38 and securing opposing ends of the pin 46 with retaining clips 52, as shown in FIG. 10. To secure the roof panel 38 in the folded position, the pins 46 may be removed from the roof panel 38 and the panel may be pivoted downward into the folded position. Each of the pins 46 may then be inserted through the opening in the structural member 88 of the roof panel 38 and then through an aligned opening 50 in one of the vertical support posts 24, as shown in FIG. 11. Clips 52 may then be installed to retain the pins 46 in place. The opening 50 in the vertical support post 24 is preferably located on a side of the post 24 aligned with one of the longitudinal beams 16 of the skid 12 and facing toward an adjacent support post 24 attached to the longitudinal beam 16. Thus, as best seen in FIG. 11, when in the folded position, the roof panel 38 may be angled slightly inward toward the skid floor 22, though the panel 38 is in a generally vertical position relative to the expanded position.

To secure the roof panel 38 in the expanded position, the panel 38 may be pivoted upwardly from the generally vertical position toward a horizontal position and the braces 40 may be secured to both the roof panel 38 and to one of the vertical support posts 24 to brace the roof panel 38 against the frame 14, as best seen in FIGS. 7 and 11A. A first end 42 of the brace 40 may be secured to a roof panel 38, and a second end 44 of the brace 40 may be secured to one of the vertical support posts 24. In the expanded position, pins 46 may be utilized to secure the braces 40 to the roof panels 38 by inserting each pin 46 through the same opening in a structural member 88 of the roof panel 38 used for securing the panel 38 in the folded position and then through an aligned opening 48 in the brace 40, which is generally near the first end 42 of the brace 40. The second end 44 of the brace 40 may then be secured to one of the support posts 24 to support the roof panel 38 in the expanded position. The second end 44 of the brace 40 is preferably secured to an outwardly facing side of the vertical support post 24, as best seen in FIG. 7. As best seen in FIG. 9, the second end 44 of the brace 40 is preferably angled so that the second end 44 fits flat against a flat side of the vertical support post 24 when the roof panel 38 is in the expanded position. In a preferred embodiment, the second end 44 of the brace 40 may be secured to the support posts 24 by inserting a pin (not shown) through an opening 54 in the brace 40 generally near the second end 44 of the brace 40 and then through an aligned opening 55 on the outwardly facing side of the support post 24. Opening 55 is shown in FIG. 10, which shows the panel 38 in the folded position and thus without the brace 40 secured to the panel 38. In a preferred embodiment, as best seen in FIG. 11A, the outwardly facing side of the support post 24 may have a support ridge 86 positioned to support the second end 44 of the brace 40 against the support post 24 without inserting a pin through openings 54 and 55. This allows the brace 40 to be supported temporarily after moving the panel 38 into the expanded position and before insertion of the pin to fully secure the panel 38 in the expanded position. In a preferred embodiment, as best seen in FIGS. 6 and 11A, each roof panel 38 has a lifting eye 84 attached to the distal end of the roof panel 38, and preferably positioned at a midpoint of the roof panel 38, for lifting each roof panel 38 into the expanded position and lowering each roof panel 38 into the folded position using a crane or hoist.

In a preferred embodiment, a single brace 40 may be utilized to support two adjacent ends of two adjacent roof panels 38 against one of the middle support posts 24 to hold both of the adjacent panels 38 in the expanded position at their adjacent ends. In this embodiment, pin 46 may be of a sufficient length to extend entirely through opening 48 of the brace 40 and also through the openings in the structural members 88 of both of the adjacent roof panels 38. The pin 46 may be retained by installing retaining clips 52 at opposite ends of the pin 46. Alternatively, two separate pins 46 may be utilized. In this embodiment, each of the middle support posts 24 may have only a single opening 55 centered on the outwardly facing side of the post 24 since only a single brace 40 needs to be secured to the middle post 24.

In one embodiment, as best seen in FIG. 2A, each of the longitudinal beams 16 may include mounting elements configured to temporarily mount each of the braces 40 onto the longitudinal beams 16 while the apparatus 10 is being transported. Each beam 16 may have one support post 90 attached to the beam 16 for each of the braces 40. The brace 40 may be removably secured to the support post 90 by inserting the support post 90 into opening 48 in the brace 40. The support post 90 may or may not be threaded. When threaded, a threaded nut may be used to fasten the brace 40 to the beam 16. If the support post 90 is not threaded, a pin or other suitable fastening device may be used to fasten the brace 40 to the beam 16. The support post 90 preferably extends outwardly from the web of the I-beam 16 such that the brace 40 fits between the flanges of the I-beam 16 so that the brace 40 fits entirely within the footprint of the beam 16. Each beam 16 preferably also has a pair of brackets 92 configured to further retain the brace 40 during transport.

In a preferred embodiment, the central roof 36 is configured to slightly overhang each of the roof panels 38 when the roof panels 38 are in the expanded position so that rain does not fall between the central roof 36 and the roof panels 38. As best seen in FIG. 4, when the roof panels 38 are in the expanded position, the length of the braces 40 is preferably designed to support the roof panels 38 in a position in which each of the panels 38 slopes slightly downward from the central roof 36 so that rainwater is directed away from the central roof 36 and toward the distal ends of the roof panels 38.

FIGS. 2-4 show roof panels 38 that extend outwardly from the central roof 36 when in the expanded position by a distance corresponding to a width of each roof panel 38, though it should be understood by one of skill in the art that the width of each of the roof panels 38 may be varied and still fall within the scope of the present disclosure. For instance, in one alterative embodiment, the roof panels 38 may be of a sufficient width to extend downward so that the distal end of each panel 38 is positioned at a point that is at or near the skid beams 16 when the panels 38 are in the folded position. In another alternative embodiment, the skid apparatus 10 may include foldable roof panels attached to adjacent support posts 24 at corners of the skid 12 formed by joints at opposite end of one of the lateral beams 18 so that a roof panel extends outwardly from the central roof 36 in a direction over one or both of the lateral beams 18 at the short ends of the skid 12.

Figure 13:
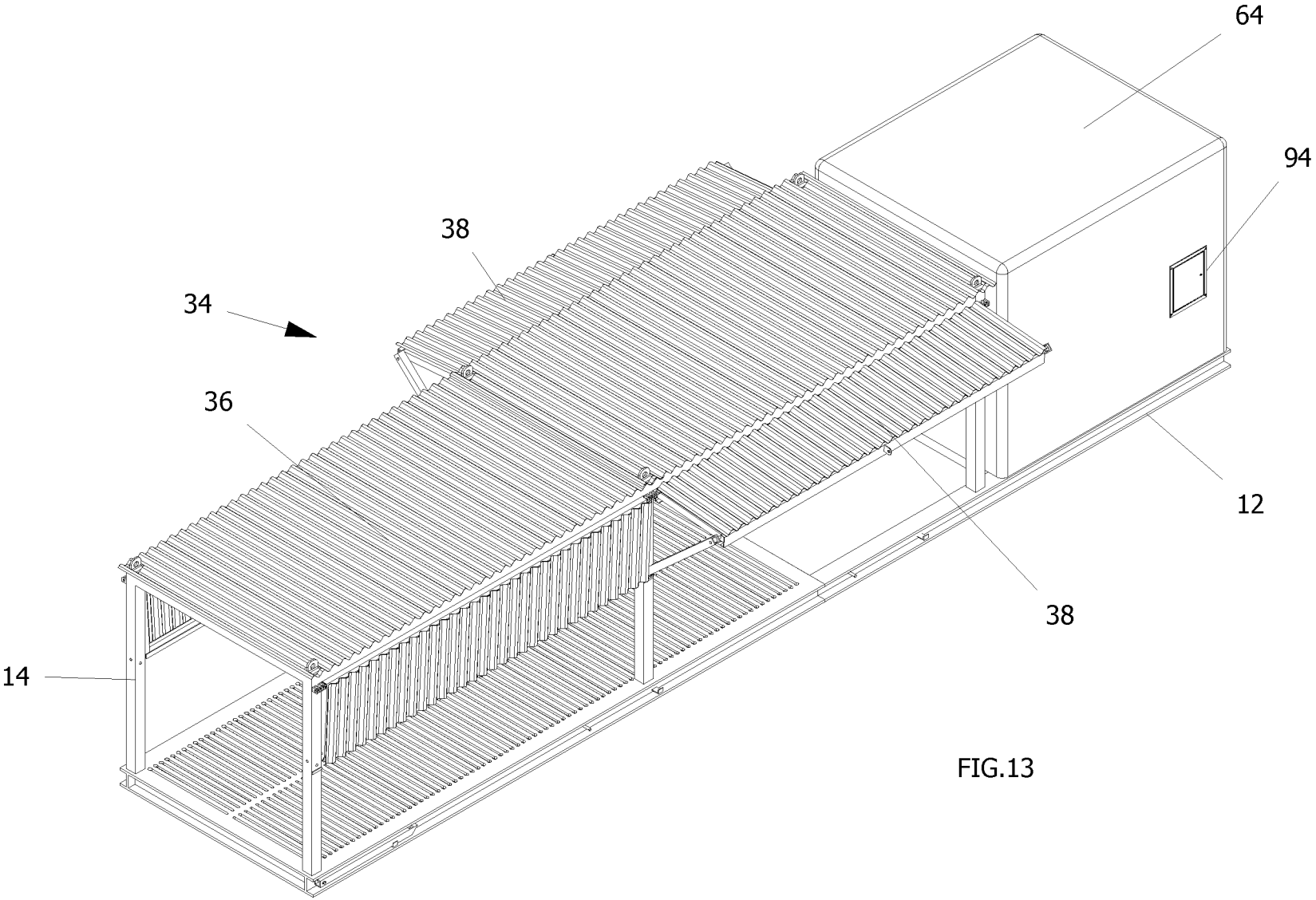
FIG. 13 shows a perspective view of an alternative embodiment of a skid apparatus including a control in accordance with the present disclosure.
Figure 17:
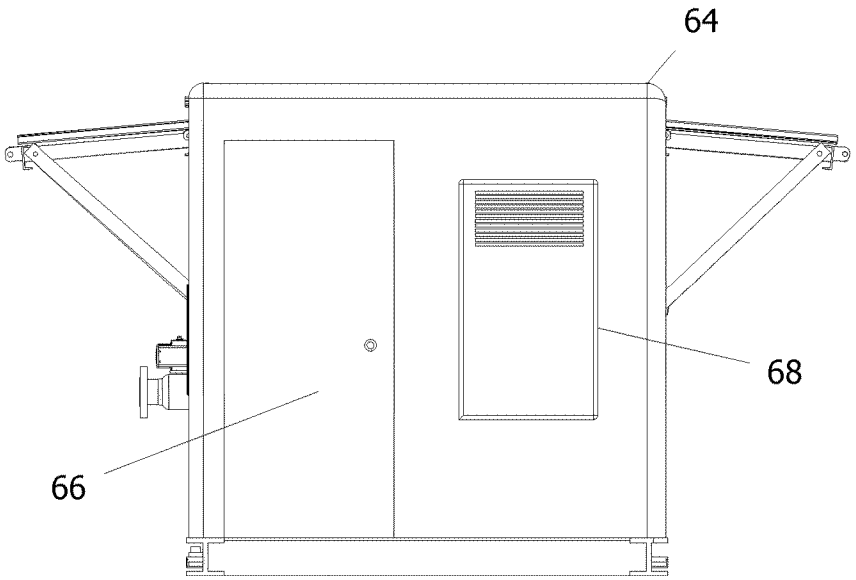
FIG. 17 shows an elevational view of an alternative embodiment of a skid apparatus including gas metering equipment in accordance with the present disclosure.
Figure 18:
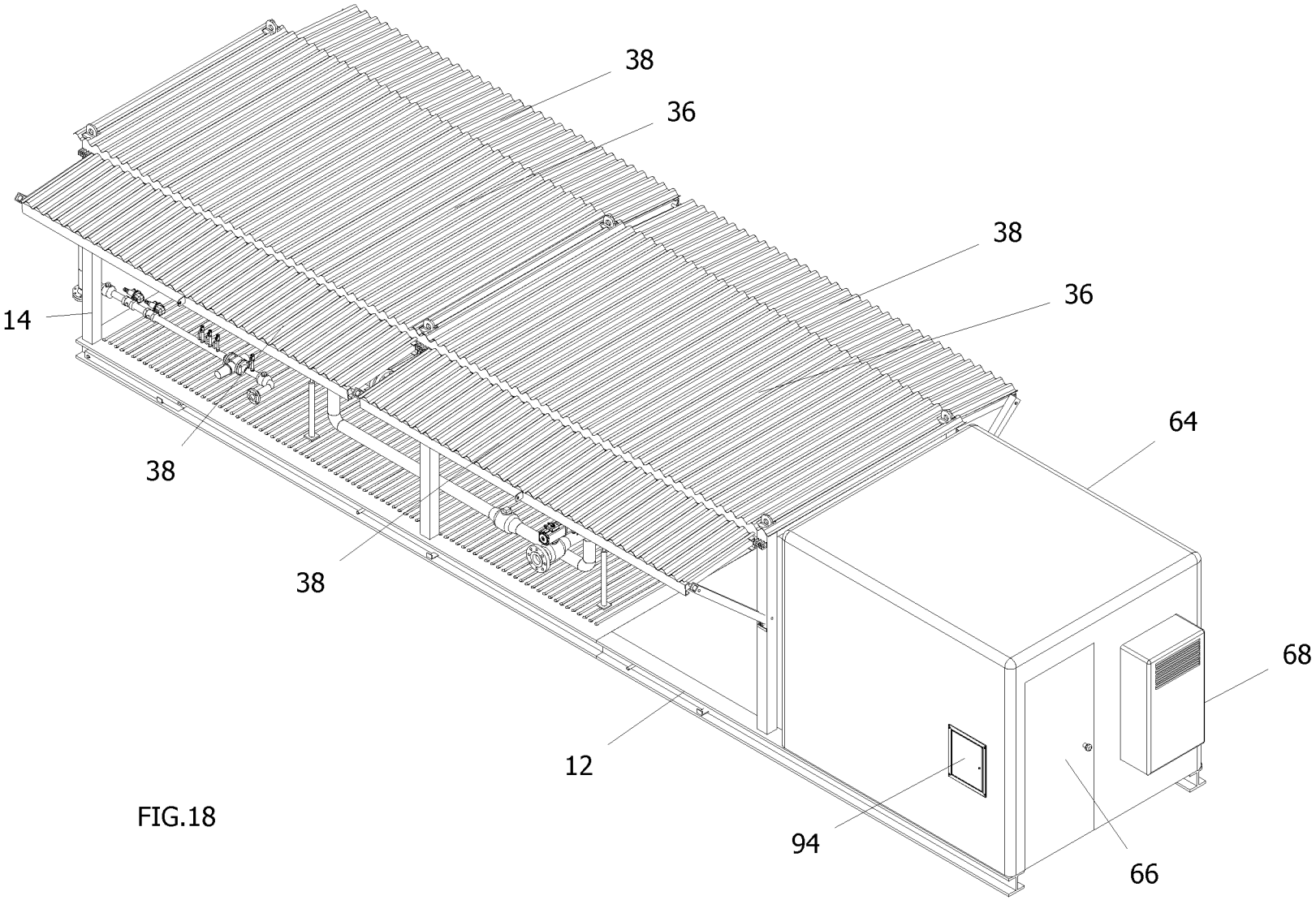
FIG. 18 shows a perspective view of an alternative embodiment of a skid apparatus including gas metering equipment in accordance with the present disclosure.

In an optional embodiment, as best seen in FIGS. 12 and 13, the skid apparatus 10 may further comprise a control room 64 attached to the skid 12, preferably outside the footprint of the roof structure 34. Alternatively, the roof structure 34 may partially or fully cover the control room 64. In this embodiment, the longitudinal beams 18 may be extended to lengthen the skid 12 to accommodate the control room 64. The control room 64 may be utilized to house certain pieces of equipment within an interior of the room 64, such as process control equipment used for controlling the equipment 70 mounted on the skid 12 and/or analysis equipment used for analyzing properties of fluids being handled by the equipment 70 mounted on the skid 12. Thus, the control room 64 may also function as an analyzer building and more generally may be used to contain any equipment related to the process for which the equipment 70 on the skid 12 is utilized. As best seen in FIGS. 17 and 18, the control room 64 comprises a door 66 that allows entry into an interior of the room 64. In a preferred embodiment, the control room 64 also includes a heating, ventilation, and air conditioning (HVAC) system 68 or other system suitable for climate control or air changing within a confined space. The HVAC system 68 may be utilized for controlling airflow into and out of the room 64 and for controlling the air temperature inside the room 64.

The control room 64 preferably comprises a base or floor, which preferably has a generally rectangular shape and may have a square shape, four walls extending upwardly from the floor, and a ceiling connected to each of the four walls, one of which includes an opening that forms a doorway that may be closed using the door 66. The floor, walls, and ceiling preferably form a continuous structure that is gapless except for the doorway 66 and any openings that may be formed in the walls, floor, or ceiling for running tubing, piping, electrical conduit, ducts, or other similar components from an exterior of the control room 64 into the interior of the control room 64 or for installing equipment on the exterior of the control room 64, such as the HVAC system 68. In a preferred embodiment, at least the portions of the control room 64 other than the doorway 66 are sealed with an airtight seal. For instance, all openings formed in the walls, floor, and/or ceiling of the control room 64 for any purpose are preferably sealed around the tubing, piping, electrical conduit, ducting, HVAC unit 68, or other component to be airtight so that air will generally not move between the interior and exterior of the control room 64, or vice versa, at such locations where openings are formed. Thus, in a preferred embodiment, air will generally only move between the interior and exterior of the control room 64 when the door 66 is open or when the HVAC system 68 is activated. In one embodiment, the door 66 and wall of the control room 64 having the door 66 may preferably be designed so that a seal around the doorway 66 also provides an airtight seal when the door 66 is closed.

Equipment 70 may be removably secured to the skid 12 so that the skid apparatus 10 is customizable to suit a user's specific needs. In some applications, the apparatus 10 and equipment 70 mounted thereon may be utilized for handling or processing flammable liquids or gases. In such applications, the HVAC system 68, the door 66, and any electrical components that are not classified for use in hazardous areas in accordance with standards set forth by the National Electric Code (NEC) and/or the National Fire Protection Association (NFPA) are preferably positioned at a location on the apparatus 10 that is outside of a prescribed distance from the equipment 70 on the skid 12 in accordance with the standards set forth by the NEC and/or NFPA. To this end, in a preferred embodiment, as best seen in FIG. 18, the control room 64 is disposed at a distal end of the skid 12 opposite a proximal end of the skid 12 at which equipment 70 is located, and the door 66 is disposed at a distal end of the control room 64 opposite the proximal end of the skid 12. Thus, the door 66 is preferably positioned on a side of the control room 64 opposite the equipment 70 mounted on the skid 12, thereby maximizing the distance between the equipment 70 and the door 66. The HVAC system 68 is preferably also installed on the control room 64 at a position outside of the prescribed distance, preferably on the same wall of the control room 64 having the door 66. Further, in a preferred embodiment, all portions of the control room 64 other than the door 66 are airtight, at least within the prescribed distance from the equipment 70 on the skid 12, which eliminates direct pathways for any flammable gases that may escape from the equipment 70 to enter the interior of the control room 64 within the prescribed distance, either via the door 66 or any other openings in the structure of the control room 64 for piping, electrical conduit, or other components to enter the control room 64. In one embodiment, the prescribed distance may be fifteen feet, and thus the doorway 66 and HVAC unit 68 are preferably at least fifteen feet away from any of the equipment 70 on the skid 12, which may be subject to hazardous classification zone codes or standards, so that any equipment housed within the control room 64 can be general classification in accordance with NEC and NFPA codes and standards and is thus not required to be explosion proof.

The control room 64 is preferably constructed of a plastic or fiberglass material that allows openings to be formed in the walls of the control room 64 for running tubing/piping and/or electrical conduit and wiring from piping or other equipment 70 mounted on the skid 12 to equipment housed within the interior of the room 64, such as process control equipment or analysis equipment. For instance, process control equipment housed within the control room 64 may include a supervisory control and data acquisition (SCADA) control system designed to control equipment 70 mounted on the skid 12. An example SCADA system may include computing devices, programmable logic controllers (PLC), user interfaces, or any other type of equipment used in industrial control systems. Analysis equipment may include any equipment utilized for analysis of gas or liquid streams handled by equipment 70 on the skid 12. The openings in the control room walls may be formed in any location so that the system may be customized. After installing tubing/piping, electrical conduit and wiring, and/or other components, the openings may be sealed around the piping or conduit in accordance with NEC and/or NFPA codes and standards to ensure that the openings are airtight and thus maintain a general classification rating within the control room. All openings located within the prescribed distance should be airtight, and preferably all openings formed in the walls, floor, or ceiling of the control room 64 are sealed to be airtight.

Figure 14:
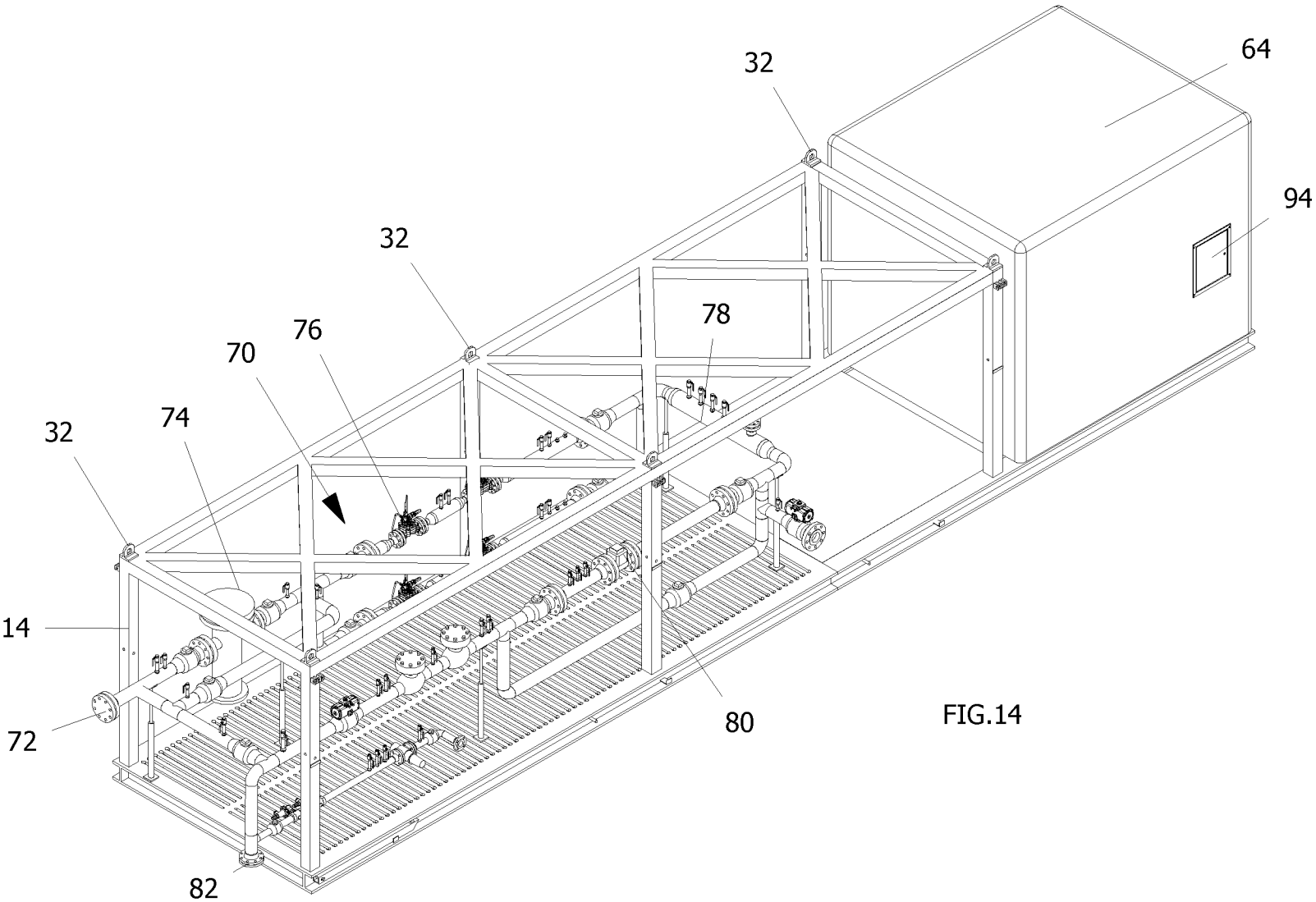
FIG. 14 shows a perspective view of an alternative embodiment of a skid apparatus including gas metering equipment in accordance with the present disclosure.
Figure 15:
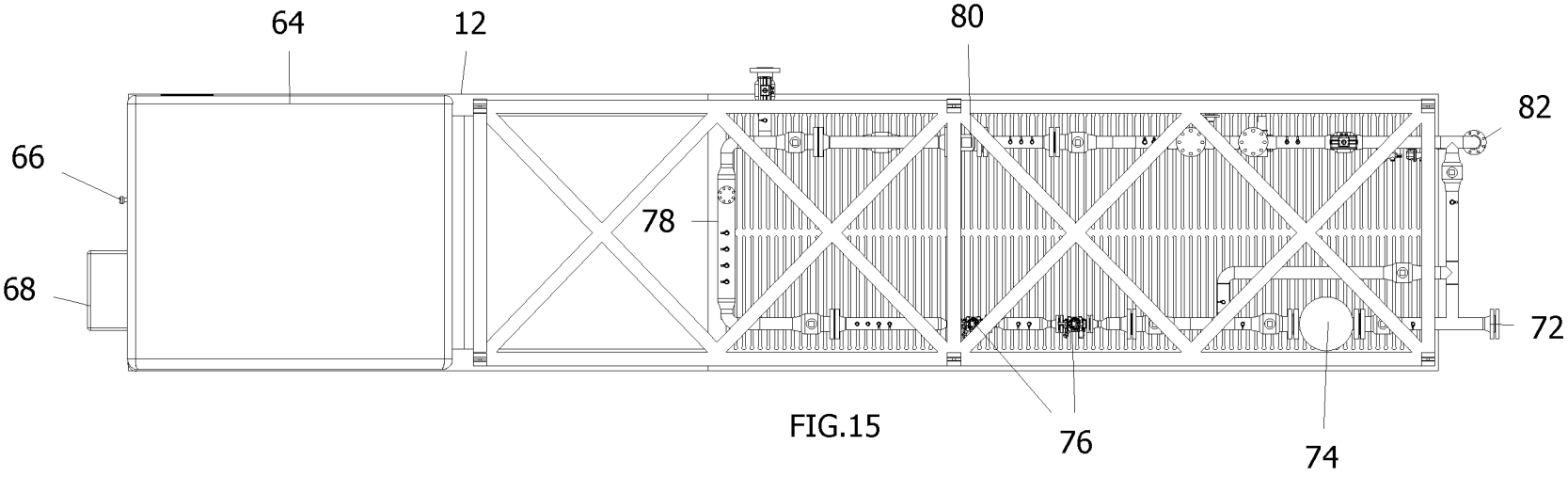
FIG. 15 shows a top plan view of an alternative embodiment of a skid apparatus including gas metering equipment in accordance with the present disclosure.
Figure 16:
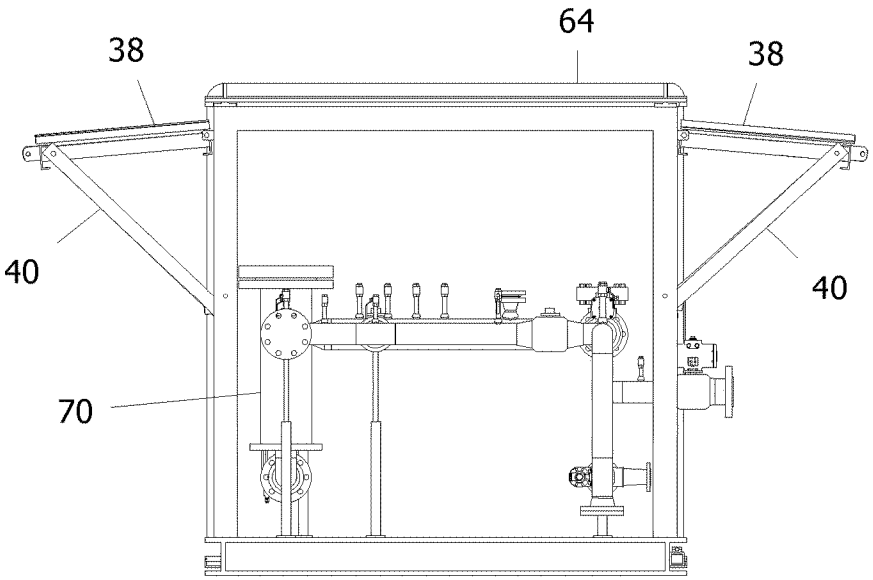
FIG. 16 shows an elevational view of an alternative embodiment of a skid apparatus including gas metering equipment in accordance with the present disclosure.

In one example embodiment, as shown in FIGS. 14-19, the skid apparatus 10 may be customized for use as a mobile gas meter station. In this embodiment, a gas metering system 70 may be installed on the skid 12. FIG. 14 shows a perspective view of the apparatus 10 and gas metering system 70 with the roof 34 removed to illustrate various components of the system 70, and FIG. 15 shows a top view also with the roof 34 removed. FIGS. 18 and 19 show perspective views of the apparatus 10 and gas metering system 70 with a roof structure 34 installed, and FIGS. 16 and 17 show side views thereof from opposing ends of the skid 12. The mobile meter station may be moved as needed to any natural gas facility, such as an RNG facility, to take custody of natural gas from the facility.

In a preferred embodiment, as best seen in FIGS. 14 and 15, the gas metering system 70 may include an inlet connection 72 for connecting the mobile system 70 to an existing natural gas facility and an outlet connection 82 to deliver metered and regulated gas from the skid apparatus 10 into an existing pipeline system or other gas transport system. The gas metering system 70 preferably also includes a gas filter 74, one or more gas flow control elements 76, a gas sampling section 78, and one or more gas meters 80. The one or more gas flow control elements 76 may include one or more pressure regulators 76, control valves, or any similar type of process equipment designed to control or regulate the flow of gas. Tubing or piping may be installed and run from the gas sampling section 78 into the interior of the control room 64 and connected to gas analyzers housed within the control room 64 for analyzing properties of the gas. The gas metering system 70 may also include various other pieces of equipment, including piping between equipment, bypass piping lines, various flanged connections for sampling and flushing, isolation valves, pressure relief valves, check valves, or other similar types of equipment.

In a preferred embodiment, as best seen in FIG. 18, the control room 64 has a recessed panel 94 on an exterior side of a wall of the control room 64 for HMI (human machine interface), RTU (remote terminal unit), PLC (programmable logic controller), or any similar type of user interface or dashboard to be housed within a recess in a location exterior to the walls of the control room 64. The recessed panel 94 may allow a user to take readings from analysis equipment housed within the control room 64 or view other data relating to processes controlled by equipment inside the control room 64 without the user having to physically enter the control room 64. The panel 94 is preferably installed on the control room 64 at a position outside of the prescribed distance and thus outside the hazardous classification area.

It should be understood by one of skill in the art that the gas metering system 70 shown in FIGS. 14-19 represents one possible application for the present skid apparatus 10 and that the apparatus 10 may be customized for any suitable industrial application and still fall within the scope of the present disclosure. For instance, the present skid apparatus 10 may be utilized for applications in the oil and gas field, industrial wastewater or other water treatment applications, chemical processing applications, or other applications in which material, which may include liquids, gases, or solid material, is processed, metered, regulated, pumped, compressed, conveyed, mixed, or transformed. In such applications, equipment mounted onto the skid 12 may include, but is not limited to, piping, valves, meters, regulators, tanks, pumps, compressors, blowers, conveyors, heat exchangers, or any other equipment suitable to be mounted onto a skid.

It will be appreciated that the configurations and methods shown and described herein are illustrative only, and that these specific examples are not to be considered in a limiting sense, because numerous variations are possible. The subject matter of the present disclosure includes all novel and non-obvious combinations and sub-combinations of the various systems and configurations, and other features, functions, and/or properties disclosed herein. It is understood that versions of the invention may come in different forms and embodiments. Additionally, it is understood that one of skill in the art would appreciate these various forms and embodiments as falling within the scope of the invention as disclosed herein.

What is claimed is:

1. An apparatus comprising:

a skid configured for removably securing equipment to the skid;

a frame attached to the skid and extending upwardly from the skid, wherein the frame comprises a plurality of vertical support posts each attached to the skid and extending upwardly from the skid, wherein each of the support posts has an upper end, wherein the upper ends of each of the support posts are connected to each other by a plurality of support members, wherein the plurality of support members forms a planar truss structure;

a roof attached to the frame and disposed in a position in which the roof covers at least a portion of the skid;

a plurality of lift lugs each attached to a top side of the frame, wherein the plurality of lift lugs are positioned on the frame in a configuration designed to enable the apparatus to be lifted in a generally upright position using the plurality of lift lugs; and a control room attached to the skid, wherein the control room comprises a door that allows entry into an interior of the control room, wherein at least portions of the control room other than the door are sealed with an airtight seal.

2. The apparatus of claim 1, wherein the control room is disposed at a distal end of the skid opposite a proximal end of the skid, wherein the door is disposed at a distal end of the control room opposite the proximal end of the skid.

3. The apparatus of claim 1, wherein the control room includes an HVAC system.

4. The apparatus of claim 1, further comprising a gas metering system removably secured to the skid, wherein the gas metering system comprises at least a gas meter and a gas flow control element.

5. The apparatus of claim 1, wherein the planar truss structure is disposed in a plane that is generally parallel to a plane in which the skid is disposed.

6. The apparatus of claim 1, wherein a respective one of the plurality of lift lugs is attached to a top side of the upper end of each respective one of the plurality of vertical support posts.

7. The apparatus of claim 1, wherein the roof comprises a central roof section and two opposing roof panels disposed on opposing sides of the central roof section, wherein the central roof section is attached to the frame, wherein the roof panels are configured to move between a contracted position and an expanded position, wherein the roof panels are configured to expand coverage of the roof when in the expanded position and to minimize coverage of the roof when in the contracted position.

8. The apparatus of claim 7, wherein the roof panels are each hingedly attached to the frame, and wherein each of the roof panels is configured to pivotally move between the contracted position and the expanded position.

9. The apparatus of claim 8, wherein the apparatus further comprises two opposing braces disposed at opposing ends of each roof panel, wherein each of the braces is connected to one of the roof panels at a first end of the brace and to the frame at a second end of the brace so that the brace rigidly supports the roof panel in the expanded position.

10. The apparatus of claim 1, wherein the skid comprises two opposing longitudinal beams and two opposing lateral beams, wherein the longitudinal beams and the lateral beams are connected to form a rectangular structure.

11. The apparatus of claim 10, further comprising a skid floor attached to at least one of the longitudinal beams and the lateral beams, where the skid floor is configured for removably securing the equipment thereto.

* * * * *